US005564178A

United States Patent [19]

Takashima et al.

[11] Patent Number: 5,564,178

[45] Date of Patent: Oct. 15, 1996

[54] PROCESS OF PRODUCING A HOT COIL AND A PRODUCTION SYSTEM OF PRODUCING THE SAME

[75] Inventors: Koichi Takashima, Toyonaka; Yoshimichi Okita, Nishinomiya, both of Japan

[73] Assignee: Kyoei Steel Ltd., Osaka, Japan

[21] Appl. No.: 303,742

[22] Filed: Sep. 9, 1994

[30] Foreign Application Priority Data

| | | | |
|---|---|---|---|
| Sep. 10, 1993 | [JP] | Japan | 5-250104 |
| Jan. 11, 1994 | [JP] | Japan | 6-013971 |
| Mar. 18, 1994 | [JP] | Japan | 6-073862 |
| Mar. 29, 1994 | [JP] | Japan | 6-083954 |

[51] Int. Cl.[6] ..... B21B 1/46; B21B 13/22

[52] U.S. Cl. ..... 29/527.7; 29/33 C

[58] Field of Search ..... 164/476, 477, 164/417; 29/33 C, 527.7

[56] References Cited

U.S. PATENT DOCUMENTS

| | | | |
|---|---|---|---|
| 4,658,882 | 4/1987 | Oba et al. | 164/417 |
| 5,182,847 | 2/1993 | Guse et al. | 29/527.7 |
| 5,212,856 | 5/1993 | Di Giusto et al. | 29/527.7 X |
| 5,303,766 | 4/1994 | Kreijger et al. | 29/527.7 X |
| 5,329,688 | 7/1994 | Arvedi et al. | 29/527.7 |
| 5,414,923 | 5/1995 | Thomas et al. | 29/527.7 |
| 5,419,172 | 5/1995 | Kim | 29/527.7 X |

FOREIGN PATENT DOCUMENTS

| | | | |
|---|---|---|---|
| 62-89501 | 4/1987 | Japan | 29/527.7 |

*Primary Examiner*—J. Reed Batten, Jr.
*Attorney, Agent, or Firm*—Wenderoth, Lind & Ponack

[57] ABSTRACT

A hot coil with high quality and low cost is produced by rolling a billet continuously prepared with a 70 to 120 mm middle thickness continuous casting mechanism, a billet conveying table, a heating mechanism, a high draft rough rolling mill, a finishing rolling mill, and a down coiler, which components are all disposed closely together along a straight line. The center surface temperature of the billet and a peripheral velocity of the roll of the high draft rough rolling mill are controlled within a predetermined range to provide for continuous rolling through the system.

12 Claims, 5 Drawing Sheets

PROCESS OF PRODUCING A HOT COIL AND A PRODUCTION SYSTEM OF PRODUCING THE SAME

FIELD OF THE INVENTION

The invention relates to a process for producing a hot coil and a production system for producing the same wherein a heating means and a rolling means are placed close to each other along a straight line of a continuous steel plate casting apparatus.

PRIOR ART

Because a hot coil requires high quality and a high productivity, the hot coil is usually produced by rolling a steel ingot prepared through a blast furnace and a converter and bloomed or a steel ingot which is produced through a continuous casting apparatus.

To perform the process from the blooming and to the hot coil rolling, a large scale blooming means is necessary. Alternatively, a continuous casting apparatus, a large scale heating means, a rough rolling mill and a finishing rolling mill are necessary.

Also required is a controlling system for controlling the process, so that the whole process requires a very large area which leads to a high cost for constructing the processing system. Also, the process control system will be very complex.

This process also requires a comparatively long time for producing a hot coil, and the temperature of the hot coil drops during processing so that a large capacity heating means is required to compensate for the temperature decrease of the product. To speed up the manufacturing process, there is a need to increase the pressure of the rolling mill, and to increase the strength of the machines, which results in a high cost of the product.

For the conventional process, the processing units in mills are disposed so as to be separated by distances corresponding to one billet length to process the billet independently to avoid interference between processes. Consequently the area for the hot coil production requires a large area. To solve the problem of this large area requirement, a coil box can be provided for coiling the roughly rolled strip. This also prevents the decrease of the temperature of the strip, improves uniformity of the temperature distribution thereof, and shortens the overall length of the processing line.

But this proposal does not fully resolve the above mentioned problems.

On the other hand, a proposed steel making process has made it possible to produce a hot strip from a thin plate prepared by a continuous casting apparatus.

According to this process, the production system becomes very simple, since the large heating means, and rough rolling mills are no longer necessary. A billet is directly cast as thin as possible, for instance 50 mm thick, or a billet is rolled inside the continuous casting apparatus to solve the problems caused by using a large and thick bloom. However, there still exists the following problems in the quality and a productivity of the products.

(a) It is difficult to product a high quality steel. Surface defects caused during the casting remain and the scales are not completely removed. Therefore, the surface condition of the steel is insufficient.

(b) For steel within the range of the peritectic point and having carbon content of 0.08–0.15 wt %, the casting rate is too rapid and a solidification condition is not constant, such that the billet contains cracks and the quality of the billet is not sufficient.

(c) It requires great skill to mount a seal and a nozzle necessary to produce a thin strip, and this effects the life of the nozzle.

(d) In the process of fast casting or slow casting, a billet is cooled ununiformly which causes thermal stress, and the billet involves powder therein which results in a fragile structure of the steel. Therefore the process is not applicable to steel which likely develops cracks inside the billet.

(e) A distance between the molds is narrow, and a molten iron rambles so that the surface condition of the steel is adversely affected and floating of the non-metal inclusion is hindered.

(f) As the draft percentage is small, defects generated in the billet remain and appear as surface defects in the strip and are difficult to remove.

(g) The scales generated during the casting process and the rolling process are very thin and stick tightly to the surface of the steel, consequently it is difficult to remove the scales completely even, by processing with a high pressure descaler which, in any event takes time and results in the temperature of the product dropping during descaling.

There are many problems to be solved as described above and it is difficult to produce a thin billet so that the thickness of the billet is limited to a certain extent.

SUMMARY OF THE INVENTION

The objective of the invention is to provide a process for producing a hot coil with high quality and low cost, by simplifying and making compact the manufacturing system and at the same time improving drawbacks of the conventional process.

The invention of this application is to solve the above described problems. According to the invention, a process comprises rolling a billet continuously prepared by a production system comprising a middle thickness continuous casting means, a heating means, high draft rough rolling mill, a finishing rolling mill, and a down coiler (or coiler), all of which are closely disposed along a straight line. A middle thickness is defined herein as from 70 to 120 mm, and more preferably ranges from 90 to 100 mm.

In the process for producing a hot coil according to the invention:

(a) a billet is formed in the continuous casting means with a thickness of from 70 to 120 mm.

(b) a processing time from the start of casting to heating in the heating means is proportional to the thickness of the billet. For example, the processing time is less than 10 minutes for a 70 mm thick billet and is less than 15 minutes for a 120 mm thick billet.

(c) the temperature of the center surface of the billet is controlled to be between 950 and 1150 degrees centigrade by the heating means of the production system.

(d) a peripheral speed of the high draft rough rolling mill is controlled to be between 5 m/min. and 20 m/min.

(e) until after the billet is subjected to the finishing roll, its temperature is maintained higher than the transformation temperature Ar3 of the steel.

The specific values such as the thickness of the billet are determined in accordance with the following.

(a) The thickness of the billet should be more than 70 mm, so that adequate distance between the mold and the nozzle is maintained to make it easy to add powder and to remove burning residue from the surface of the billet, such that the continuous casting process is effectively carried out.

The shaking of the cast iron in the mold is considerably suppressed to thereby make it possible to reduce the involvement of the scales and the development of cracks. Also, it is possible to steadily float the non-metal inclusions in the molten iron so that high quality of the hot coil will be obtained.

The scales will develop on the surface of the cast iron, so that it is possible to remove them with a conventional descaler, without using a high pressure descaler.

As the billet has a certain thickness, the temperature of the billet will not fall rapidly or will remain uniform since the heat capacity of the billet prevents a temperature drop.

An adjustment of the volume for maintaining the unit weight of the hot coil to be produced will become easy.

As the upper limit of the thickness of the billet is 120 mm, the manufacturing equipment can be small and compact compared with the equipment for the conventional method using a comparatively thick ingot. The height of the machines of the invention will also be relatively low, and the static pressure caused during the solidification of the steel becomes rather low so that the need for auxiliary equipment which prevents deformation of the billet and also prevents generation of defects inside the billet will be reduced. It is necessary to make the temperature distribution of the billet uniform in a short time, taking into account the heat from inside the billet and heat added to the billet as a whole and to the edge part of the billet by the heating means.

According to the invention, the capacity of the heating means can be minimized and further it is possible to synchronize the heating process and the rolling process.

(b) Time limit from casting to heating

The temperature of the billet will drop from the beginning of the casting until it reaches the heating means, and the temperature distribution will become non-uniform, but according to the invention, the time elapsed from processing in the casting means to processing in the heating means is restricted as proportional to the thickness of the billet, for instance, less than 10 minutes for 70 mm thick, less than 11 minutes for 80 mm thick, less than 12 minutes for 90 mm thick, less than 15 minutes for 120 mm thick. Therefore, the heat inside the billet is effectively utilized and the capacity of the heating means need not be large.

(c) The center surface temperature of the billet after heating.

The temperature of the billet during the rolling greatly influences the quality of the product and the productivity.

Even in the conventional process, the temperature is strictly controlled depending on the required quality of the product and the energy efficiency.

In the process of the invention, the billet is continuously rolled from the heating means to the down coiler by placing the high draft rough rolling mill close to the finishing rolling mill such that rolling is executed just after the heating process and the temperature drop of the billet is prevented.

Therefore, the temperature of the center surface of the billet is maintained at from 950 to 1150 degrees centigrade, comparatively lower than the temperature of the conventional process to prevent the surface of the roll from becoming rough and to improve the energy efficiency of the process.

It is not preferable to keep the temperature of the billet lower than 950 degree because it becomes impossible to keep the temperature of the billet higher than the transformation temperature Ar3 of the steel until just after the finishing mill. Meanwhile it is not preferable to raise the temperature billet higher than 1150 degree since doing so will adversely effect the quality of the product, particularly the smoothness of the surface of the roll, and the energy efficiency.

(d) Peripheral speed of the high draft rolling mill.

In the conventional process, it is very important to shorten the time duration of rolling because the temperature drop effects the quality of the product. In the conventional large hot coil manufacturing equipment with several stages of rough rolling mills, the peripheral speed of the first rough rolling mill is higher than 30 m/minute, in general 70 m/minute.

In this invention of the application, as the billet is continuously rolled between the heating means and the down coiler, the speed is defined depending on the discharging speed of the final product from the equipment. The discharging speed is dependent on the heating temperature of the billet, the thickness of the product and a condition to maintain the temperature of the product higher than the transformation temperature Ar3 of the steel at the finishing roll mill. The peripheral speed of the high draft rough rolling mill can be lower than the conventional speed for instance, from 5 m/minute to 20 m/minute.

According to the invention, rolling is conducted while heating the billet, and the temperature drop is very small so that the peripheral speed of the rolling mill can be lower than the conventional speed. It is possible to set a draft percentage at one stand of the high draft rough rolling mill at a comparatively high value. On the other hand, in the conventional process, the peripheral speed of the rolling mill must be high enough to prevent the temperature drop during the processing so that the draft percentage ought to be low compared with the process of the invention. According to the invention, the number of high draft rolling mills is reduced and the time duration of rolling becomes extremely short.

Consequently draft percentage at one stand of the high draft rough rolling mill can be more than 40%, more preferably more than 50%, which is high compared to the conventional process.

It is also possible to reduce the speed of the product passing through the equipment, thereby minimizing the mechanical specifications of the equipment for instance, reducing the capacity of the motor and the rigidity of the finishing rolling mill.

(e) Temperature at the finishing rolling mill when the product passes through the roll.

The temperature of the billet during the rolling has a large influence on the quality of the product and productivity, so the temperature is strictly controlled depending on the required quality of the product and the energy efficiency.

In the process of the invention, the billet is continuously rolled between the heating means and the down coiler by placing the high draft rough rolling mill close to the finishing rolling mill such that rolling is executed while heating the billet. Therefore, the temperature difference between the leading and the trailing ends becomes very small and it is possible to set the center surface temperature of the billet at a rather low temperature compared with the conventional method. Moreover even the rolling speed is reduced and it becomes possible to maintain the temperature of the billet higher than the transformation temperature Ar3 of the steel just after the finishing rolling mill such that a high quality product is obtained and high operability of the rolling is accomplished.

Further, a reduction of rolling speed at the finishing rolling mill makes it possible to increase the water cooling efficiency at the strip conveying table which consequently shortens the whole length of the production system.

According to the invention, a middle thickness billet is continuously rolled between the heating means and the down coiler by placing the high draft rough rolling mill close to (or proximate) the finishing rolling mill, and it becomes possible to simplify and make compact the manufacturing equipment and to produce high quality products at low cost.

Another objective of this invention is to produce high quality products in a variety of species introducing a cold billet into the closely disposed heating means and rolling means which are aligned with the continuous casting means.

To achieve the above objective, the process of this invention comprises heating a cold billet in a heating furnace which is out of the production line and introducing the billet into the manufacturing equipment of the invention.

A process of producing a hot coil comprises heating a large cold billet with a heating furnace which is disposed out of the manufacturing line, introducing the billet into the manufacturing equipment, rolling the billet several times with the rough rolling mill and rolling the billet with the finishing rolling mill.

A production system for a hot coil comprises a middle thickness billet continuous casting means, a heating means, a high draft rough rolling mill, a finishing rolling mill and a down coiler which are all aligned along a straight line, and a heating furnace for heating a cold billet disposed out of the production line.

In a production system of the invention, the high draft rough rolling mill is disposed close to the finishing rolling mill, and the finishing rolling mill is provided with a guide means for guiding the billet into the finishing rolling mill and a support roller for supporting the billet.

According to the invention, it is possible to produce a product having a similar quality which is supplied from the middle thickness continuous casting means by heating a cold billet manufactured out of the production line or introducing a cold billet having a different or higher quality for producing a variety of products.

It might be possible to operate the production system by introducing a cold billet into the system by heating the billet in the furnace even if a supply of the billet stops from the middle thickness continuous casting means because of an accident, maintenance or a temporary shutdown of the machine.

The process of the invention is applicable to a cold billet having a conventional thickness by rolling the billet several times with the high draft rough rolling mill into a predetermined thickness and introducing it into the finishing rolling mill. In this case, the length of the billet is extended by high draft rolling and the extended billet will collide against the finishing rolling mill if the high draft rough rolling mill and the finishing rolling mill are placed close to each other, but the extended billet is introduced into the finishing roll without touching the rolls by widening the distance between the rolls. Subsequently the production line of the hot coil is shortened and made compact and, a heat diffusion from the production line is reduced.

Another objective of this invention is to provide a heating tunnel furnace which is used or operated when the rolling means accidentally stops or is stopped for maintenance and concurrently the length of the production line is shortened compared with the conventional process.

To achieve the above objective, in a production system for a hot coil according to the invention, the heating means consists of a billet heating tunnel furnace which is divided into parts, the length of one of the divided parts is longer than the length of the billet subjected to heating, the heating tunnel furnace is movable in a direction perpendicular to the direction of the production line, a movable auxiliary heating furnace having the same length and the same heating capacity as the heating tunnel furnace is disposed parallel to the heating tunnel furnace on a line between the continuous casting means and the high draft rolling mill, and a billet conveying means along the line of and at either end of the waiting position of the auxiliary heating tunnel furnace or along the line of the side position of the heating tunnel furnace for introducing and extracting the billet into the heating furnaces.

Usually the movable heating furnace is placed between the continuous casting means and the high draft rolling mill, that is along the production line, and hot coils are produced.

In case there occurs an accident in the rolling process and the rolling operation is stopped, for instance for about 5 to 10 minutes, a billet manufactured and supplied from the continuous casting means is stored in the heating tunnel furnace, which is then moved laterally while containing the billet therein. Then the auxiliary heating furnace is placed between the continuous casting means and the high draft rolling mill and another billet supplied from the continuous billet is received inside the auxiliary heating furnace.

In case the rolling machine is expected to stop for a rather long time, and a further billet is supplied from the continuous casting means, either of the billet contained in the heating furnace or in the auxiliary furnace is extracted from the heating furnace using the conveying means and discharged out of the production line. This operation is repeated until the continuous casting means stop supplying billets. Therefore even if a problem occurs in the rolling machine, the production system of the hot coil of this invention is continuously operated.

In the heating furnace which is not connected to the billet conveying means, the billet is heated and waits until the rolling machine starts operation.

When the rolling machine restarts, the furnace is replaced into the production line and the waiting billet inside the heating furnace or auxiliary heating furnace is introduced into the rolling machine to restart the production of the hot coils.

The billet discharged out of the production line and cooled under the atmospheric conditions is heated again in a different heating furnace to the temperature of rolling and returned to the production line using the billet conveying means.

Another objective of this invention is to remove scales from the heating furnace while heating the billet and to provide a scale removing apparatus which is also used as an automatic scale discharger.

According to the invention, the heating furnace comprises at least one funnel-like hopper for receiving scales falling from the billets disposed at the level of the hearth of the furnace, and a discharging conveyer disposed below the lower opening of the hopper which is driven back and forth with strokes of 10 to 30 mm, and 100 to 400 cycles per minute at high speed in both the forward and backward directions.

DETAILED EXPLANATION OF THE INVENTION

The invention is further explained with reference to the attached drawings.

Figure 1:
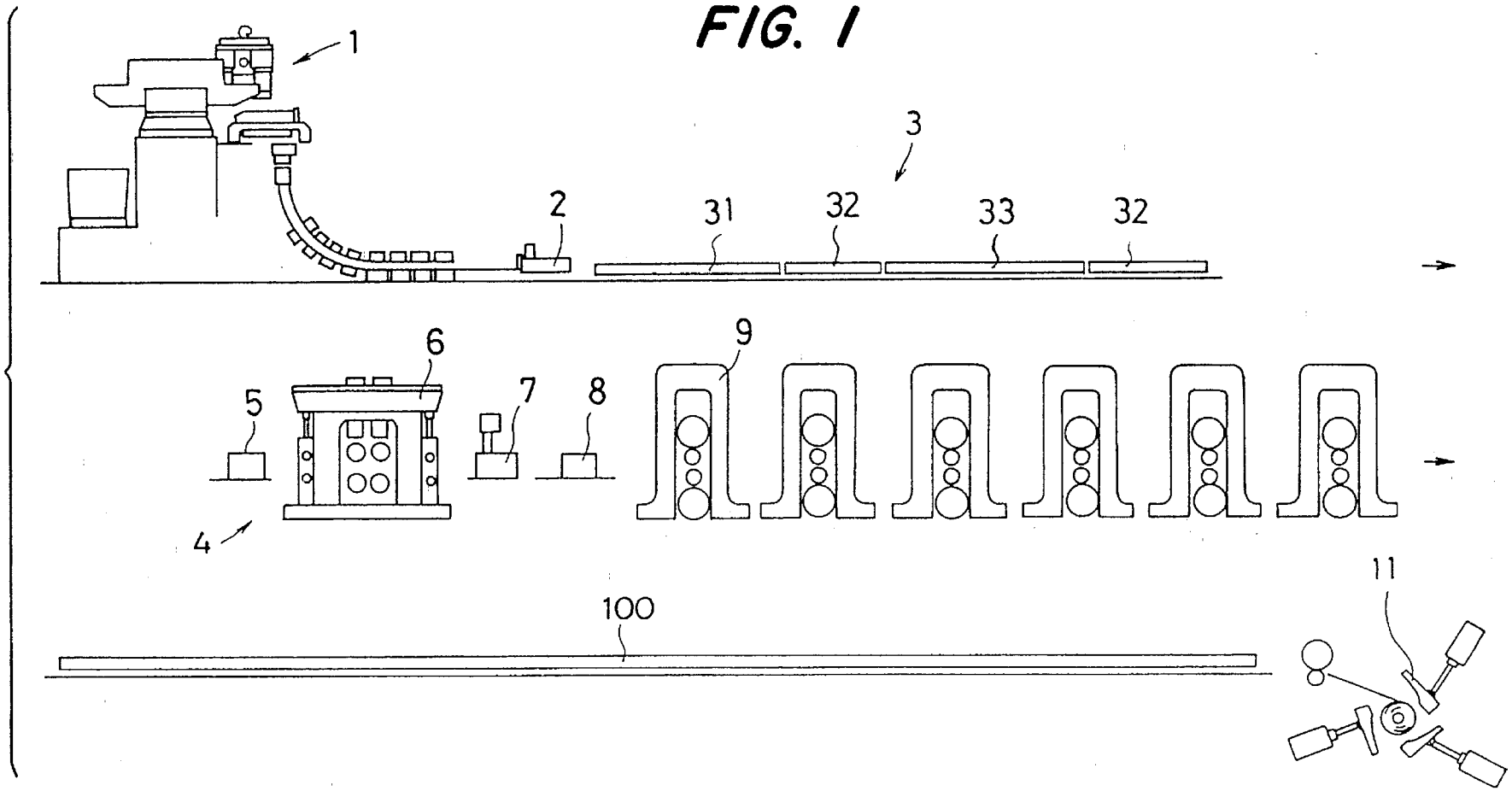
FIG. 1 is a side view of the production system for a hot coil.
Figure 2:
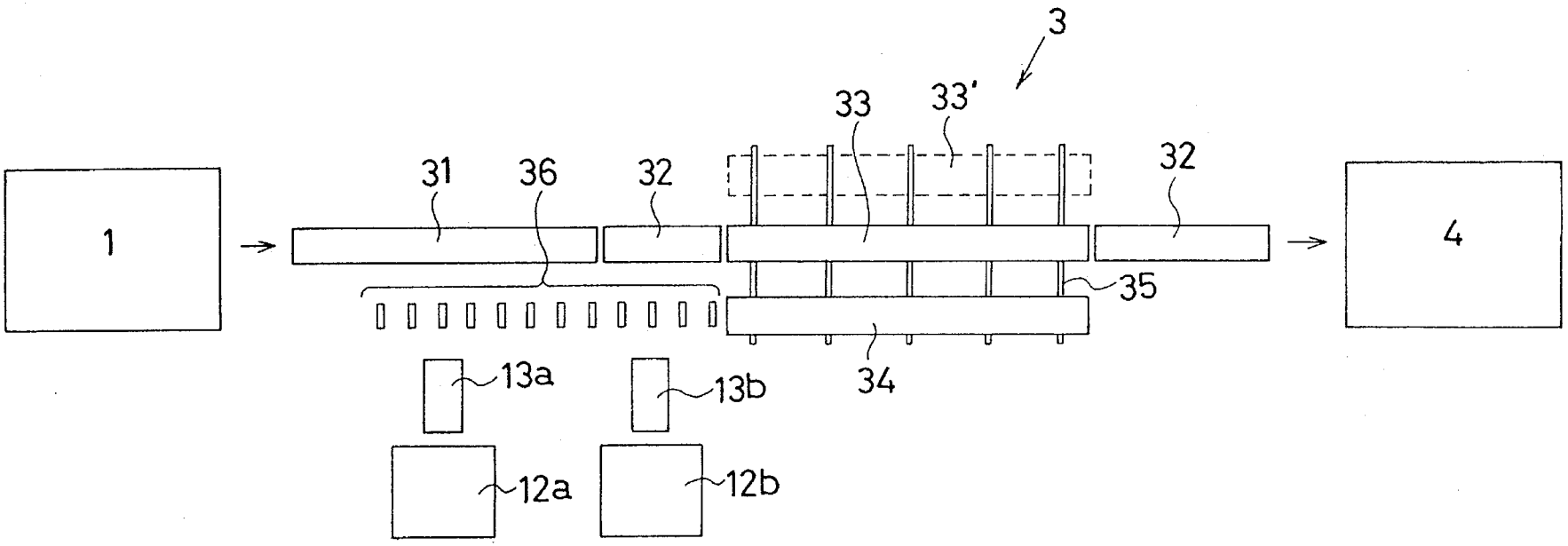
FIG. 2 is a plane view of the production system for a hot coil.

FIG. 1 and FIG. 2 show an example of the equipment of the invention. The production system comprises a continuous casting means 1 for supplying a middle thickness billet having a thickness of 70 mm to 120 mm, more preferably 90 mm to 100 mm, a cutter 2, a heating tunnel 3 for heating the billet, a de-scaler 5, a rolling means 4 consisting of a high draft rough rolling mill (or roughing mill) 6, a shear 7, a de-scaler 8, a finishing rolling mill 9, a billet conveying table 100, and a down-coiler (or coiler) 11 for coiling the rolled hot strip. All of the components are closely disposed and aligned along a straight line.

The heating tunnel 3 is divided to two parts, one is heating part 31, and the other is an equalizing part. The equalizing part is further divided into three parts of which the middle part 33 has a length longer than the length of the billet subjected to rolling (the length is dependent on a weight of the coil to be produced, but in general it is 15 meter long). The middle part 33 of the heating tunnel is movable on rails 35 perpendicular to the production line.

Alternatively, the heating part 31 can be designed to be movable instead of the equalizing middle part 33.

It is preferable to construct the heating part 31 of the heating tunnel 3 as an induction heating means.

An auxiliary heating tunnel 34 having the same length and the same capacity as the heating tunnel 3 is disposed alongside the heating tunnel 3. The auxiliary tunnel is connected with the middle part 33 of the heating tunnel 3 so if the middle part 33 of the heating tunnel is moved to the waiting position 33' (shown in phantom lines in FIG. 2), the auxiliary heating tunnel 34 is placed in the production line between the continuous casting means 1 and rolling means 4. However, the auxiliary heating tunnel 34 and the heating tunnel 3 may be moved independently.

If the auxiliary heating tunnel 34 is installed with the burners or the like just like the heating tunnel, it works as a heating tunnel in the production line in place of the heating tunnel 3.

A billet conveying means 36 comprising a roller table is disposed along the line of the waiting position of the auxiliary heating tunnel 34 and connected to one of the openings of the auxiliary heating tunnel from which the billets are introduced or discharged.

The level of the roller table of the billet conveying means is preferably disposed at the same level as the roller table disposed inside the auxiliary heating tunnel. The billet conveying means is designed to discharge the billet completely from the auxiliary heating tunnel but is also designed to introduce a cold billet into the auxiliary heating tunnel. To accomplish this purpose, heating furnaces 12*a*, 12*b* and conveying tables 13*a*, 13*b* are placed alongside the conveying means 36.

Another conveying means may be disposed along the line of the waiting position 33' of the middle part 33 of the heating tunnel for the same purpose as described for the auxiliary heating tunnel. If another conveying means is provided for the middle part 33, the conveying means 36 may be omitted.

Connecting parts between the divided heating tunnel have necessary openings to pass the billet and are sealed with each other to prevent radiation of heat, discharging of hot gas, and suction of air into the tunnel.

The inside of the movable part 33 of the heating tunnel 3 or the auxiliary heating tunnel 34 is maintained at a slightly higher pressure than atmospheric pressure to prevent a temperature drop due to suction of the air, and the openings of the tunnels are provided with shutters which allow the billet to pass therethrough, for example, automatic doors or air curtains. This type of shutter is applicable to the openings of other heating tunnels.

During operation of the system, exhaust gases from the heating tunnel 3 are introduced into the auxiliary heating tunnel 34 for preheating the auxiliary heating tunnel 34 to save energy costs.

Figure 3:
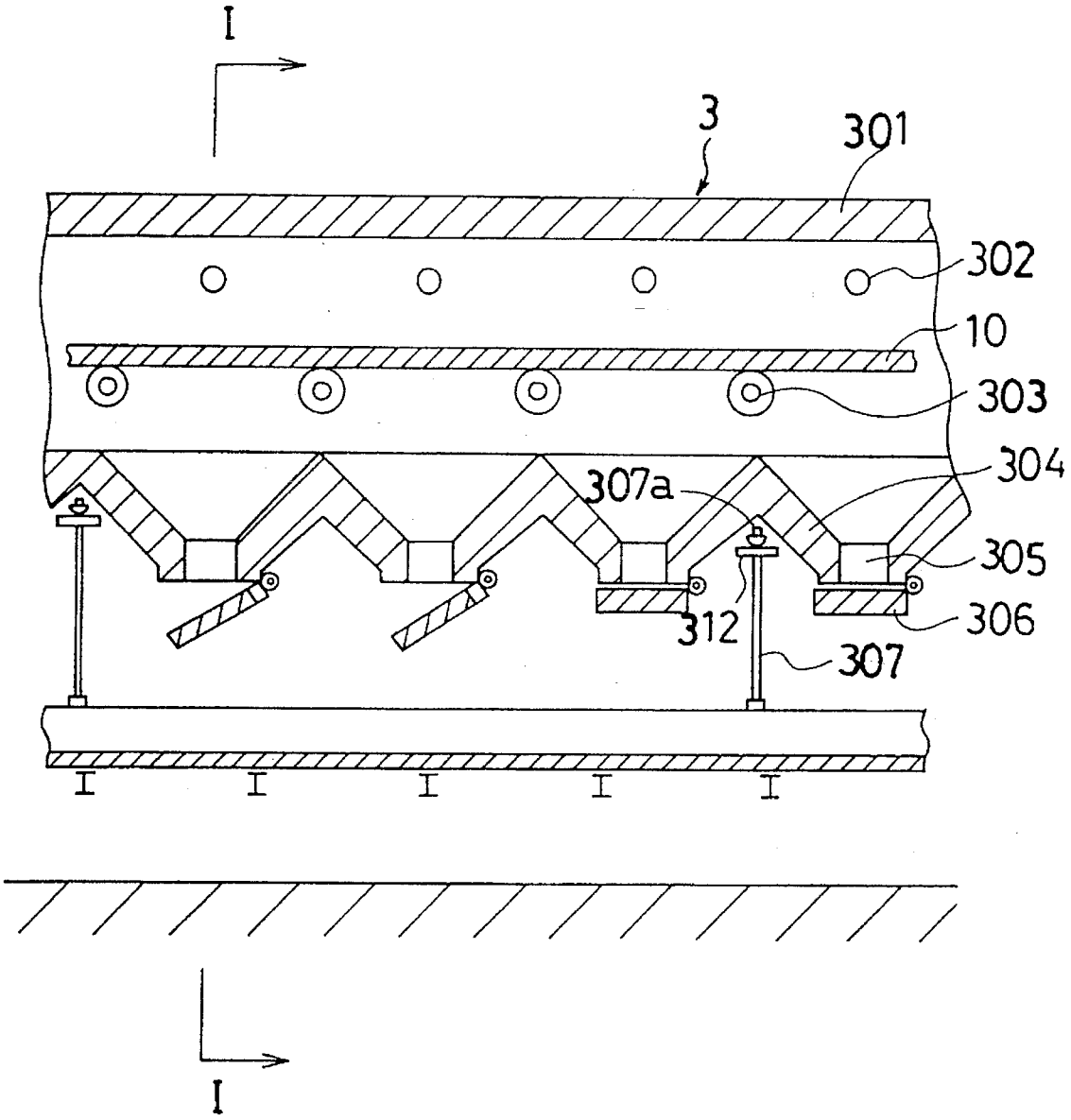
FIG. 3 is an embodiment of a scale discharging apparatus.
Figure 4:
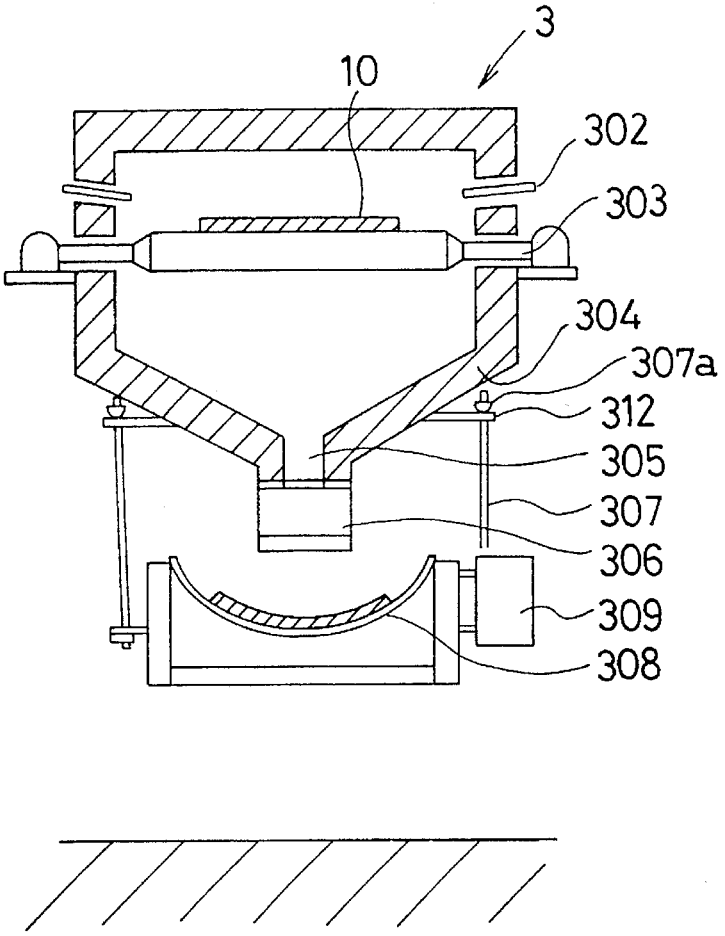
FIG. 4 is a cross sectional view taken along line I—I in FIG. 3.
Figure 5:
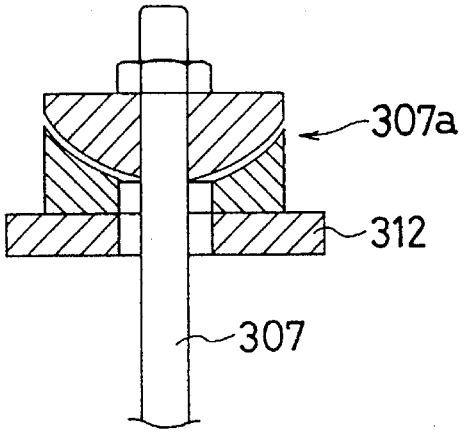
FIG. 5 is a detail view of a bolt support mechanism.
Figure 6:
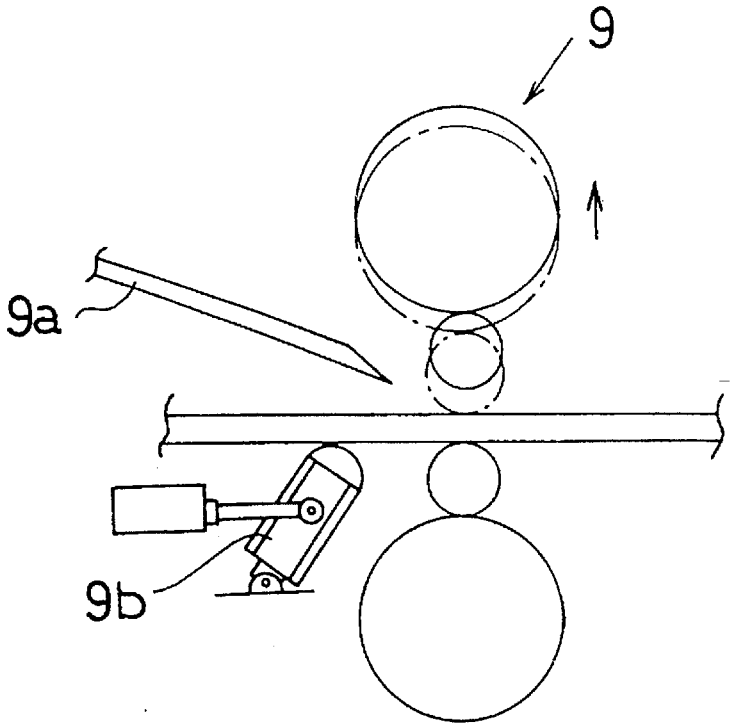
FIG. 6 is an example of a finishing roll mill.

Referring to FIG. 3 to FIG. 5, a scale discharging means disposed inside the heating tunnel 3 or heating furnace 12*a*, 12*b* is explained in more detail.

Inside the heating tunnel 3, burners 302 are disposed at an upper side of the tunnel to heat up the billet 10 directly moving on rollers 303. Funnel-like (or funnel-shaped) hoppers 304 are disposed lengthwise and under the rollers to receive scales or the like generated anywhere in the tunnel while heating, so that it is possible to receive all the scales.

Lower openings of the hoppers are preferably closed with doors 306 driven by liquid pressure cylinders to prevent suction of air into the tunnel or blowing out of flames from the heating tunnel 3, and also to accumulate scales at the bottom of the hoppers for a predetermined time or until the accumulated scales reach a predetermined weight.

It is also preferable that the hoppers 304 and doors 306 are lined with fire resisting materials, and further that the doors are provided with a water cooling system.

A ditch-like (or upwardly concave) conveyer 308 is disposed below the openings 305 of the hoppers 304. The conveyer 308 is made of steel and is covered with fire resisting materials or has an installed water cooling system.

The conveyer 308 is suspended level with respect to the tunnel with swing bolts 307 and is driven back and forth by a driving means 309 with a stroke of 10 to 30 mm, 100 to 400 cycles/min. at a low speed when moving forward and at a high speed when moving backward.

Swing bolts 307 are anchored swingably by a swing mechanism 307*a* to the brackets 312 fixed to the foundation side of the heating tunnel and allow the conveyer to be driven back and forth horizontally.

The velocity ratio of back and forth movement is 1 to 3.

The driving means 309 drives the conveyer 308 back and forth with a stroke of 10 to 30 mm, 100 to 400 cycles/min. At a low speed when moving forward and at a high speed when moving backward thereby periodically moving the removed scales or the like falling down on the conveyer from the hopper.

The driving means comprises for instance a vibrator with unbalanced weights, with a cam mechanism or with an oil pressure cylinder.

The driving means may be mounted directly on the conveyer, but it is preferable to install the driving means outside the heating tunnel and connect it with the vibrating mechanism disposed at the conveyer by a link mechanism or a power transmitting means, because of the environment in the tunnel such as high temperature and scattering of cooling water, and for ease of maintenance of the equipment.

Transportation capacity of the conveyer 308 driven back and forth is rather powerful so that it is unnecessary to incline the conveyer, but in some cases the conveyer can be inclined upward in a discharging direction. This allows the equipment to be designed more freely.

A space for housing the conveyer 308 can be minimized because there is little limitation as to a layout of the conveyer 308.

Therefore a depth of the underground construction for housing the conveyer is small, thereby reducing the cost of construction, and it is also useful for heat insulation against the heat radiation from the heating tunnel.

At the end of the conveyer 308, a truck or another conveyer may be disposed if desired.

The hoppers 304 and the conveyer 308 may be divided depending on the length of the heating tunnel. If the tunnel is long, a plurality of conveyers may be used depending on the length of the tunnel.

If the conveyer is divided, a truck or a movable conveyer for transporting the removed scales is disposed at each end of the conveyer, or one truck and one movable conveyer are commonly used interchangeably at both ends of the conveyer.

Scales generated during the heating process will fall down into the funnel-like hoppers 304 and accumulate at the bottom of the hoppers. When the lower opening doors of the hoppers are opened, scales drop onto the conveyer 308. The bottom opening doors are opened to let the scales fall by gravity when a predetermined amount of scales accumulates at the bottom of the hoppers or after a predetermined time passes after the previous drop of the scales. A discharge of the scales from the hopper is preferably conducted automatically.

As the driving means 309 drives the conveyer 308 back and forth with a stroke of 10 to 30 mm, 100 to 400 cycles/min. at a low speed when moving forward and at a high speed when moving backward, the removed scales are moved to the end of the conveyer 308 and the scales are discharged to a truck or another conveyer. After the temperature of the scales drops to a moderate temperature they are subjected to disposal.

The driving means is preferably synchronized with the opening action of the bottom opening door.

Descalers 5, 8 disposed next to the heating means 3 and the high draft rough rolling mill are of a type using high draft water to remove scales generated on the surface of the billet. Alternatively, the descalers are of a type comprising a light pressure roller or pinch roller to destroy scales and remove them with high pressure water or compressed air.

The high draft rough rolling mill 6 comprises two pairs of large diameter rolls having a large receiving capacity.

The finishing rolling mill 9 includes a plurality of rolling mills having quadruple rolls. In the embodiment, a series of 6 finishing rolling mills are used but the number of the finishing rolling mills is not restricted to the number described in the embodiment, but is rather changeable depending on the required quality of the product.

The finishing rolling mill is designed to receive the billet between a gap of the rolls after the billet has been rolled by the high draft rolling mill and has had its length extended.

More specifically, the distance between the finishing rolls can be changed very rapidly to receive the extended billet and a guide means 9*a* and a support roll 9*b* are disposed in front of the finishing rolls or one side or both sides of the finishing rolls to guide the billet therebetween. It is preferable to electrically control the high draft rough rolling mill, the finishing rolling mill, the guide means, and the support roll to harmonize the functions thereof.

According to the conventional continuous casting system, it is difficult to produce a small amount of each of a variety of products since a certain amount of one product is produced consecutively for a certain period. When a user requests a small quantity of a special type of hot coil, it was impossible to change the specification of the products.

However, according to the invention, a cold billet of desired quality is introduced in the heating furnace 12*a*, 12*b* for raising the temperature of the billet and is brought into the heating means via conveying table 13*a* 13*b*, and a small quantity of specially ordered steel can be promptly produced. This is also applicable when a supply of billet from the continuous casting means is stopped for maintenance or accidentally stops.

The cold billet is rolled by the high draft rolling mill like the billet supplied from the continuous casting means, and is manufactured into a hot coil through the finishing rolling mill, and coiled by the down coiler. When the cold billet has the same steel quality of the billet supplied from the continuous casting means, there is no difference in the quality of the hot coil.

A production process will be explained hereinafter.

A middle thickness plate cast with the continuous casting means is introduced into the heating means 3 and is heated uniformly and descaled therein. The billet is then rolled by the high draft rough rolling mill to a predetermined thickness and scales are again removed by a descaler. Finally the strip is rolled to a final thickness of the product by the finishing rolling mill. The strip is coiled into a coil by the down coiler.

In this process, the same billet is rolled continuously between the heating means and the down coiler and:

(a) the billet is formed in the continuous casting means having the thickness of 70 to 120 mm, preferably 90 mm to 100 mm;

(b) a processing time from starting of casting to processing by the heating means is proportional to the thickness of the billet, for example less than 10 minutes for a 70 mm thick billet and less than 15 minutes for a 120 mm thick billet;

(c) the temperature of the center surface of the billet is controlled to be between 950 and 1150 degrees centigrade by the heating means;

(d) a peripheral speed of the high draft rough rolling roll is controlled to be between 5 m/minute and 20 m/minute; and (e) the temperature of the billet is maintained until after the finishing rolling mill is maintained at higher than the transformation temperature of Ar3 of the steel.

The peripheral speed of the high draft rough rolling mill is 5 m/min. to 20 m/min. which is rather slow compared with the conventional method, a draft percentage at the first stand of the rough rolling mill is more than 40%, and more preferably is higher than 50%.

A more specific example of the production of a hot coil will be explained hereinafter.

A billet of 90 mm square section from a middle thickness continuous casting equipment, and a 250 mm square section billet from a heating furnace 12*a*, 12*b* are supplied out of the production line via a conveying table 13*a*, 13*b*.

The 90 mm billet is rolled to 30 mm thickness with one roll of the high draft rolling mill and from 30 mm to 1.2 mm with one roll of the finishing rolling mill, and is then coiled by the down coiler 11.

The 250 mm square section billet from a heating furnace 12*a*, 12*b* transferred out of the production line via a conveying table 13*a*, 13*b* is supplied to the high draft rough rolling mill, rolled to 30 mm with three rolls, and from 30 mm to 1.2 mm with one roll of the finishing rolling mill, and is then coiled by the down coiler 11.

Dimensions and weights of the billet and the strip are as follows:

Values in the parentheses are exemplary.

BILLET
WEIGHT MAX 30 t (20 t)
THICKNESS 70–120 mm (70 mm)
LENGTH MAX 30M (25M)
STRIP (FINAL PRODUCT)
WEIGHT MAX 30 t
THICKNESS 1.2–12.7 mm
WIDTH 900 mm–1600 mm

What we claim is:

1. A hot coil manufacturing process carried out with a hot coil production system comprising a middle-thickness continuous billet casting unit, a heating unit, a high-draft roughing mill, a finishing mill and a coiler, all disposed along a straight line, wherein a billet is continuously rolled between the heating unit and the coiler, and wherein the process comprises:

operating the continuous billet casting unit to produce a billet having a thickness of 70 to 120 mm;

transferring the billet produced by the continuous billet casting unit from the continuous billet casting unit to the heating unit such that the time elapsed from the start of casting in the continuous billet casting unit to the arrival of the billet at the heating unit is approximately proportional to the thickness of the billet, with the time being under 10 minutes for a billet having a thickness of 70 mm and the time being under 15 minutes for a billet having a thickness of 120 mm;

controlling the heating unit so that the surface temperature at a center of the billet is 950° to 1150° C. after being heated in the heating unit;

operating the roughing mill such that a first roll thereof has a peripheral speed of 5 m/min to 20 m/min; and controlling the hot coil manufacturing process such that the temperature of the billet after being heated by the heating unit until completion of its passage through the finishing mill is maintained higher than the transformation temperature of steel.

2. A hot coil manufacturing process as recited in claim 1, wherein said step of controlling the hot coil manufacturing process involves placing the roughing mill and the finishing mill sufficiently close together along said straight line so that the billet is maintained at a temperature higher than the transformation temperature of steel without further heating the billet after heating thereof in the heating unit.

3. A hot coil production system comprising:

a production line including a middle-thickness continuous billet casting unit for casting a billet, a billet heating unit, a high-draft roughing mill, a finishing mill and a coiler, all disposed along a straight line;

wherein said high-draft roughing mill and said finishing mill are mounted proximate one another along said straight line with no heater unit being interposed therebetween;

wherein a guide member is provided for guiding the billet into said finishing mill; and wherein a support roll is provided for supporting the billet as it is guided into said finishing mill.

4. A hot coil production system as recited in claim 3, further comprising a heating furnace disposed outside of said production line for heating cold billet for introduction into said production line.

5. A hot coil production system as recited in claim 4, wherein said heating unit comprises a billet heating tunnel furnace;

said billet heating tunnel furnace is divided into a plurality of parts, one of said parts being longer than the length of the billet to be subjected to heating therein; and said one of said parts of said billet heating tunnel furnace being movably disposed for movement in a direction perpendicular to said straight line between an operating position along said straight line and a standby position.

6. A hot coil production system as recited in claim 5, further comprising an auxiliary tunnel furnace having substantially the same length as said one part of said billet heating tunnel furnace, being disposed in parallel to said billet heating tunnel furnace, and being movably disposed for movement in a direction perpendicular to said straight line between an operating position along said straight line and a waiting position.

7. A hot coil production system as recited in claim 6, further comprising a billet conveyor provided along a longitudinal extension line of one of said auxiliary tunnel furnace when in said waiting position and said one of said parts of said billet heating tunnel furnace when in said standby position.

8. A hot coil production system as recited in claim 7, further comprising funnel-shaped hoppers respectively provided in said billet heating tunnel furnace and said auxiliary tunnel furnace for receiving scales falling from the billet when passing therethrough; and wherein each of said hoppers has a lower opening through which the scales can be discharged; and wherein upwardly concave elongated conveyors are respectively disposed below said lower openings of said hoppers and are respectively operable to reciprocate horizontally with a stroke of 10 to 30 mm and a frequency of 100 to 400 strokes/min with a higher speed when moving in a forward direction than when moving in a backward direction.

9. A hot coil production system as recited in claim 3, wherein said heating unit comprises a billet heating tunnel furnace;

said billet heating tunnel furnace is divided into a plurality of parts, one of said parts being longer than the length of the billet to be subjected to heating therein; and said one of said parts of said billet heating tunnel furnace being movably disposed for movement in a direction perpendicular to said straight line between an operating position along said straight line and a standby position.

10. A hot coil production system as recited in claim 9, further comprising an auxiliary tunnel furnace having substantially the same length as said one part of said billet heating tunnel furnace, being disposed in parallel to said billet heating tunnel furnace, and being movably disposed for movement in a direction perpendicular to said straight line between an operating position along said straight line and a waiting position.

11. A hot coil production system as recited in claim 10, further comprising a billet conveyor is provided along a longitudinal extension line of one of said auxiliary tunnel furnace when in said waiting position and said one of said parts of said billet heating tunnel furnace when in said standby position.

12. A hot coil production system as recited in claim 11, further comprising funnel-shaped hoppers respectively provided in said billet heating tunnel furnace and said auxiliary tunnel furnace for receiving scales falling from the billet when passing therethrough; and wherein each of said hoppers has a lower opening through which the scales can be discharged; and wherein upwardly concave elongated conveyors are respectively disposed below said lower openings of said hoppers and are respectively operable to reciprocate horizontally with a stroke of 10 to 30 mm and a frequency of 100 to 400 strokes/min with a higher speed when moving in a forward direction than when moving in a backward direction.

* * * * *